United States Patent [19]

Gray

[11] 4,185,160

[45] Jan. 22, 1980

[54] ELECTRIC SLOT FURNACE

[76] Inventor: Donald I. Gray, 1106 Cedar Ave., St. Charles, Ill. 60174

[21] Appl. No.: 897,593

[22] Filed: Apr. 19, 1978

[51] Int. Cl.[2] ..... H05B 1/02

[52] U.S. Cl. ..... 13/24

[58] Field of Search ..... 13/24, 20, 25, 22

[56] References Cited

U.S. PATENT DOCUMENTS

| | | | |
|---|---|---|---|
| 2,422,734 | 6/1947 | Jung | 13/24 |
| 2,600,313 | 6/1952 | Mershon | 13/24 X |
| 3,311,694 | 3/1967 | Lasch, Jr. | 13/24 |
| 4,061,870 | 12/1977 | Mizushina | 13/24 |

*Primary Examiner*—Roy N. Envall, Jr.

*Attorney, Agent, or Firm*—Edmond T. Patnaude

[57] ABSTRACT

An electric slot furnace for heating metal bars to a forging temperature includes four corner posts from which a hearth and a hot box are independently supported with a layer of insulation located therebetween, the hot box being connected to the posts by means of springs to permit movement of the hot box relative to the hearth during expansion and contraction of the furnace.

5 Claims, 8 Drawing Figures

ELECTRIC SLOT FURNACE

The present invention relates in general to slot furnaces of the type commonly used to heat metal bars for a forging process, and it relates in particular to a new and improved electric slot furnace of modular construction which may be easily disassembled for normal maintenance and repair, which is relatively inexpensive to manufacture, and which is economical in operation.

BACKGROUND OF THE INVENTION

In the past, forging furnaces have generally been heated by the burning of fossil fuel such as oil or gas or they have been heated by the use of electricity. Fossil burning furnaces have heated the metal work pieces by radiant energy while the electric furnaces have employed induction or resistance heating. However, the prior art fossil fuel radiant heating furnaces are very noisy, release noxious fumes and raise the temperature in the vicinity of the furnace to a level which is uncomfortable to the operator. Moreover, the fossil fuel forging furnaces are relative inefficient being of the order of about 10 to 15 percent efficient. In recent years fossil fuels have not been available in certain geographic areas for some industrial uses, and furnaces operating on electricity would be desirable.

On the other hand, although electric heating is efficient (50–85%) induction or resistance heating equipment of the prior art is wasteful of the metal being forged inasmuch as the "holds" at the ends of each piece being forged must be discarded. For example, if the "hold" portions are each one inch in length and the piece being forged is eight inches in length, a nine inch bar must be used for each part being forged. There is thus a waste of about ten percent of the metal being forged. This is not the case where radiant heating is used and consequently, it is desirable to provide an electrically heated, radiant furnace for use in forging and similar operations such as upsetting.

SUMMARY OF THE INVENTION

Briefly, there is provided in accordance with the present invention a new and improved electric slot furnace wherein forging bars or the like may be heated by radiant energy. This furnace is quiet and clean in operation, does not appreciably heat up the area around the furnace and enables the operator to work from the end of the bars so as to minimize the material which must be discarded.

In order to be relatively inexpensive to manufacture, economical to operate and not unpleasant to use, the furnace of this invention comprises a support frame to which the hot box and the hearth are separately mounted, and walls of insulation are disposed between the hearth and the hot box to define the slot into which the metal bars are placed for heating. The hot box is supported from the frame by springs to permit vertical movement of the hot box in the frame as it expands and contracts during changes in temperature of the walls of insulation and of the hot box itself.

The hot box itself is of novel construction and incorporates an inverted U-shaped central section which is slidably mounted to the frame of the furnace and to which the front and rear sections of the hot box are removably attached for ease of assembly and disassembly. Preassembled insulating modules line the top and side walls of the central section, and these modules can be independently removed for repair or replacement. The front and rear sections of the hot box are lined with stacks of insulation which are supported from the top by a plurality of suspension rods which are connected to the top walls of the hot box by springs to permit vertical movement of the rods as the insulation expands and contracts in response to temperature changes, and insulation shrinkage due to aging.

All of the walls of the hot box are formed by a plurality of separate metal plates welded together at widely spaced locations to enable the use of small gauge metal plates without subsequent buckling as the temperature of the furnace is increased. Also, the hot box is constructed so as to radiate the greatest amount of heat toward a location near the open end of the slot where heat loss is the greatest.

In order to maximize the life of the electric heating elements mounted in the hot box, electric control means are employed which respond to the temperature of the heating elements to limit the power supplied thereto to a relatively low value until the temperature reaches a value of say 1400° F. Above this temperature value the applied power is substantially greater. Also there is a maximum heating element temperature at which current to the heating elements is interrupted.

Within these high and low temperature limits the power supplied to the heating elements is responsive to the average temperature in the slot so that energy is supplied to the heating element on demand and only when the furnace temperature is a slight amount of, for example, 10° F., below a predetermined value of, for example 2400° F.

GENERAL DESCRIPTION OF THE DRAWINGS

A better and more complete understanding of the present invention may be had from a reading of the following detailed description taken in connection with the accompanying drawings wherein.

DETAILED DESCRIPTION OF THE DRAWINGS

Figure 1:
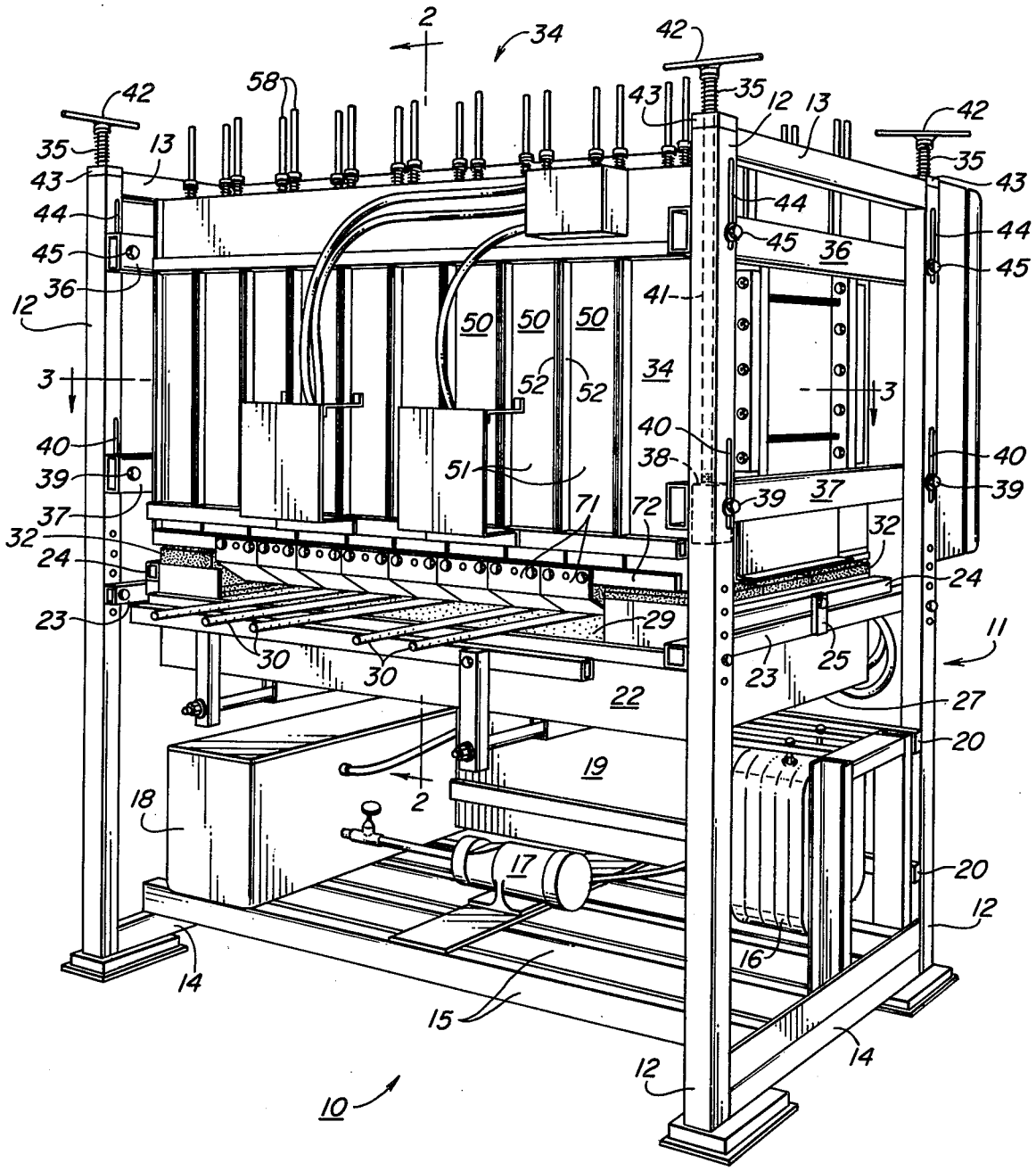
FIG. 1 is a perspective view of an electric slot furnace embodying the present invention and particularly showing the front and right hand side of the furnace.

Referring in particular to FIG. 1, an electric slot furnace 10 comprises a frame 11 including four tubular corner posts or uprights 12. The two corner posts 12 on each side of the frame are connected together by upper and lower tubular cross brace members 13 and 14, respectively, with the bottom cross brace members 14 being interconnected by a plurality of horizontal tubular members 15. The tubular members 15 not only connect the sides of the frame into a single unit, but they also provide a support for various parts of the furnace including a cooling fan or blower 16, a pump 17 and a liquid coolent tank 18 from which the cooling liquid is pumped through an SCR control power pack and through the coils of the blower 16. As may be seen, an electric control box 19 containing the electric control devices opens at the back of the furnace and is mounted on a pair of horizontal cross braces 20 extending between the two rear corner posts 12.

In order to support a self-contained hearth 22 at an elevated position for convenient use of the furnace, a pair of tubular rails 23 are fastened to the front and rear corner posts 12 at a height, easily changed, forty to fifty inches from the floor. The hearth 22 includes a pair of horizontally disposed tubular support members 25 which rests on the rails 23. The rails 23 provide the sole support for the hearth which may thus be slidably removed as a complete unit from the frame 11 onto a fork-lift truck. A bracket 25 which is fixed to the rail 23 as, for example, by a weldment, may be bolted to the member 24 to prevent spurious movement of the hearth 22 in the frame.

Figure 2:
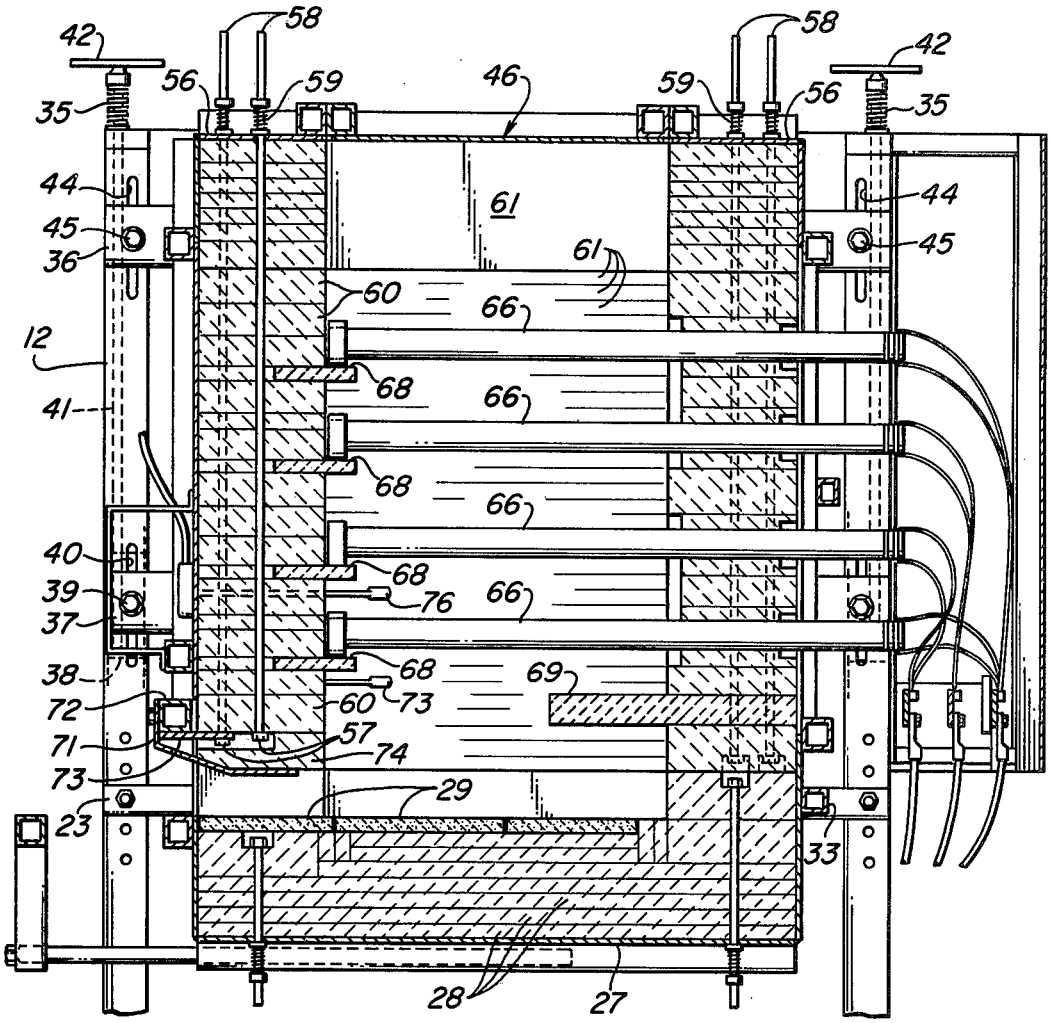
FIG. 2 is a vertical section taken along the line 2—2 in FIG. 1.

The hearth 22, as best shown in FIG. 2, includes a metal box 27 which is open at the top and contains a plurality of pieces of insulation 28 arranged in a number of layers. The insulation stack has a planar upper surface formed by an upper layer of hard fire brick 29. As more fully described hereinafter, the metal bars rest directly on the upper surface of the bricks 29 while being heated. A number of metal forging bars 30 are shown in FIG. 1 in the normal heating positions wherein they lie in side-by-side relationship on the bricks 29.

Resting on the hearth and insulating the sides and rear of the slot of the furnace are a plurality of pieces of insulation 32 arranged in a generally C-shaped configuration with the open end at the front of the furnace. The insulation 32, which is partially enclosed by the side and rear walls of the metal box 27, extends a short distance of about one inch above the side walls of the box 27. A square metal tube 33 is welded to the rear wall of the box 27 to prevent buckling thereof.

A hot box 34 is disposed in the frame above the hearth 22 and rests directly on the insulation 32. Inasmuch as the compressive strength of the insulation 32 is insufficient to support the entire weight of the hot box 34, the hot box 34 is also partially supported by the corner posts 12. Moreover, the supporting connection to the posts 12 includes a plurality of coil springs 35 whereby the hot box 34 can move vertically in the frame as the insulation 32 and the hot box itself expand and contract in response to changes in temperature. As best shown in FIG. 1, the hot box 34 includes two upper and two lower tubular horizontal support members 36 and 37, respectively, which are fixed to the outer sides of the hot box in a manner more fully described hereinafter. The lower support members 37 are connected near their front and rear ends to respective blocks 38 slidably disposed in the tubular corner posts 12 by means of bolts 39 positioned for vertical sliding movement in vertical slots 40 in the corner posts. A plurality of threaded tie rods 41 are respectively secured at their upper ends to the crank 42 and extend down through the associated posts and are threaded into the blocks 38. The coil springs 35 are positioned over the upper end portions of the rods 41, and a plurality of collars 43 are respectively welded on the upper ends of the rods over the springs whereby the springs are compressed between the collars 43 and respective caps **43*a* provided on the tops of the posts 12. It may thus be seen that rotation of the crank 42 adjusts the vertical position of the hot box 34** in the frame.

The upper support members 36 are slidably connected to the frame by means of a plurality of bolts 45 which loosely extend through vertical slots 44 in the corner posts 12. The upper portion of the hot box 34 is thus also slidably mounted to the posts 12 and can move relative to the bottom of the hot box in response to temperature changes thereof. The springs 35 are selected so that they partially, but not completely, support the weight of the hot box. Therefore, as the insulation 32 expands and contracts, the box 34 is moved up and down to maintain a tight seal against the insulation 32 without straining or fracturing the insulating material.

Figure 3:
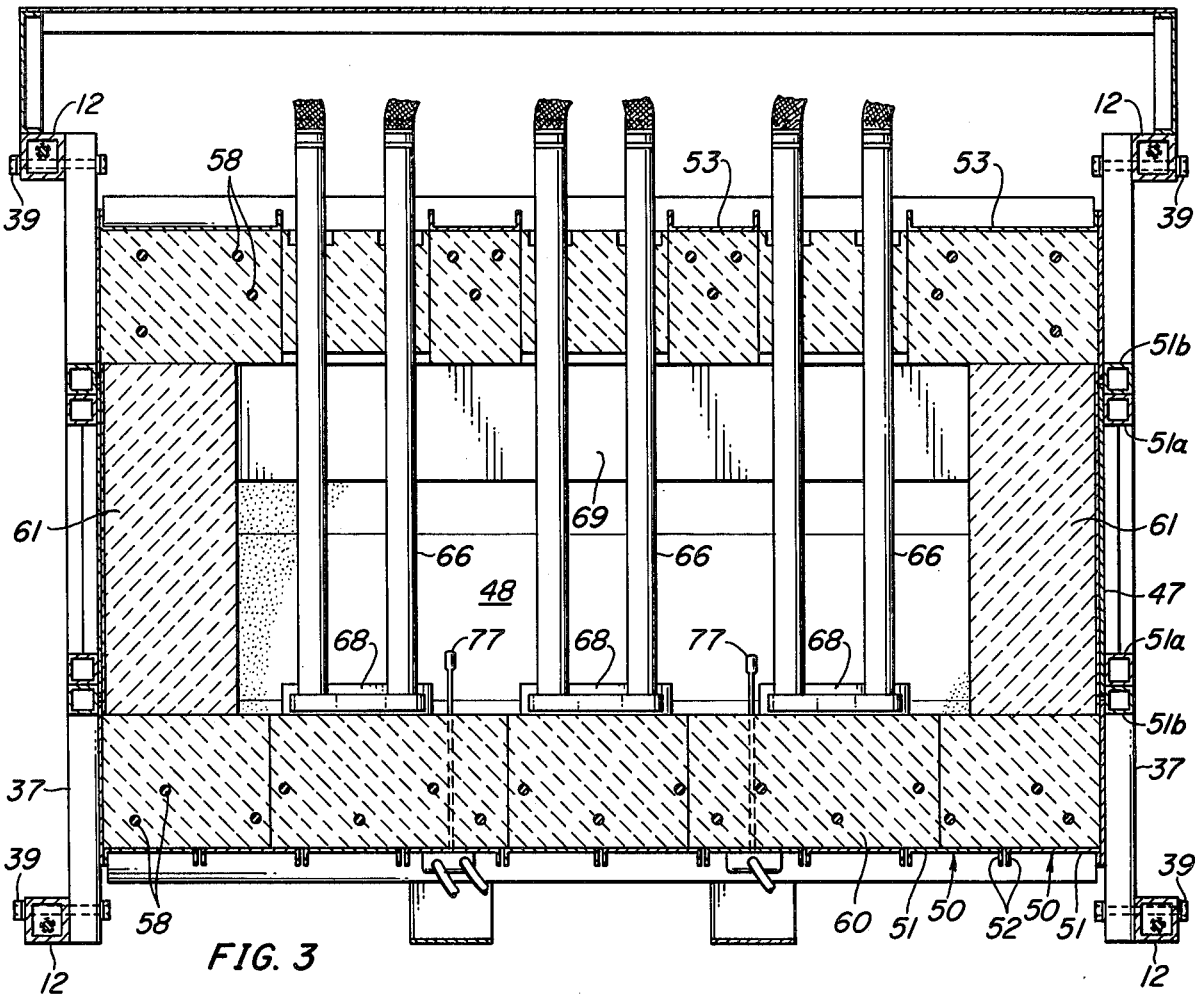
FIG. 3 is a horizontal section taken along the line 3—3 in FIG. 1.
Figure 5:
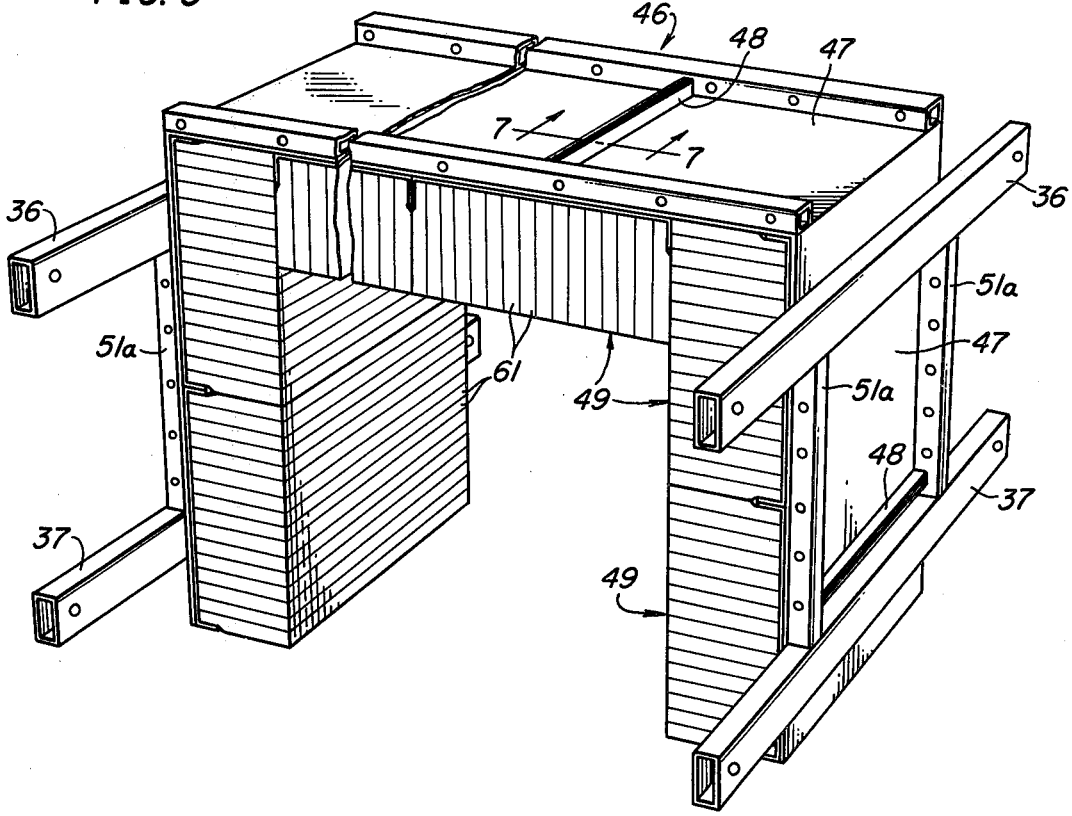
FIG. 5 is a fragmentary, isometric view of the central section of the hot box portion of the furnace of FIG. 1.

The hot box 34 includes a main, central section 46 which is best shown in FIG. 5. This is the main section of the hot box and is substantially in the shape of an inverted "U". It includes two vertical side walls and a top wall. Each of the three walls comprises a plurality of metal members 47 having outwardly extending flanges 48 which are welded together only at the front and rear ends to permit expansion and contraction of the plates without buckling. Tubular frame pieces **51*a* are welded to the front and rear side wall members 47, and similar tubular frame members 51*b* are provided on the front and rear hot box sections. The side channels 47 are welded to the support members 36 and 37, and the frame members 51*b* of the front and rear sections of the hot box are suitably bolted to the frame members 51*a* of the central section as shown in FIG. 3**.

The front wall of the front section of the hot box is formed by a plurality of vertically oriented channel members 50 having their respective web portions 51 disposed in mutually coplanar relationship and their side flanges 52 extending outwardly. The members 50 are spot welded together near the upper and lower ends only, and like the members 47 the members 50 are slightly spaced apart when at normal room temperature to permit substantial independent expansion thereof when the furnace is operating at elevated temperatures. The rear wall of the hot box is also formed by a plurality of vertically disposed metal channel members 53.

In order to line the front and rear sections of the hot box with insulation, a plurality of tension rods 58 are supported from the top plates 56 by means of a plurality of coil springs 59 and extend to approximately the bottom of the hot box through aligned holes in a plurality of layers of insulation 60 with the head end at 57 below the bottom layer 60. The insulating layers 60 are thus suspended by the rods 58 and are free to expand and contract as the furnace temperature changes, and to maintain compression of the layers when insulation shrinkage occurs.

The central section 46 of the hot box is lined with a plurality of insulating modules 49 each including a stack of insulating boards 61. These modules 49 are individually mounted to the top and side walls in juxtaposed relationship as shown in FIG. 5.

Figure 6:
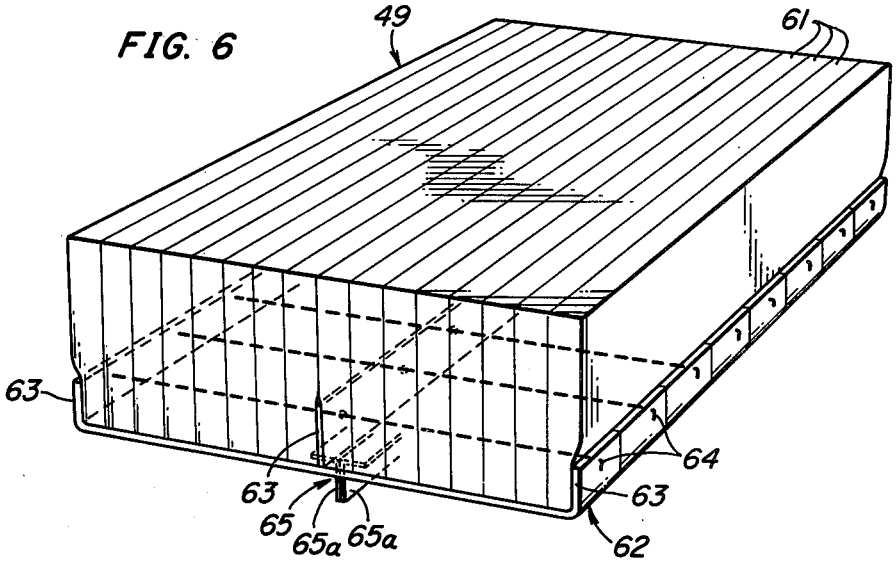
FIG. 6 is an enlarged, isometric view of one of the insulating modules used to line the inner walls of the central section of the hot box as shown in FIG. 5.

With particular reference to FIG. 6 it may be seen that each of the modules 49 includes a channel member 62 formed of expanded material. These pieces of insulation 61 are stacked in the channel 62 between the side and center flanges 63 and are held in place by means of a plurality of wire rods 64. The rods 64 extend through aligned openings in the flanges 63 and are offturned at their ends to prevent spurious disassembly of the module.

Figure 7:
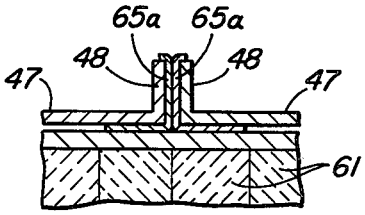
FIG. 7 is a sectional view taken along the line 7—7 in FIG. 5 and showing the manner in which the insulating modules are attached to the walls of the central section of the hot box.

In order to fasten the modules 49 to the top and side walls of the central hot box section, a plurality of pairs of angle sheet metal members 65 are welded to the bottom wall of the channel 62, and the outwardly extending flanges 65*a* are inserted into one of the slots between the flanges 48 of adjacent ones of the top channel plates 47. The angle members 65 are formed of thin sheet metal whereby the distal end portions can be bent over the edges of the flanges 48 as shown best in FIG. 7. In like manner other ones of the modules 49 are attached to the side walls of the hot box in mutual juxtaposed relationship.

Figure 4:
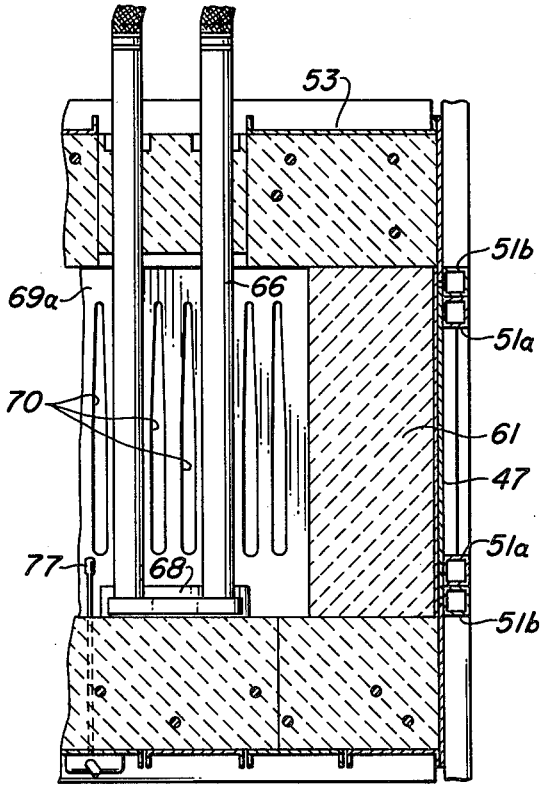
FIG. 4 is a fragmentary horizontal section showing the manner in which the heating element are mounted in the hot box and also showing an alternative feature of the present invention.

As may be seen in FIGS. 2 and 3, a plurality of conventional glow bar heating elements 66 are generally U-shaped, and ceramic shelves 68 are inserted into the layers of insulation 60 on the front wall extend inwardly into the open central space in the hot box to provide a plurality of shelves 68 on which the forward ends of the elements 66 rest. Also, one of the insulating layers in the rear wall, which layer is identified by the number 69, extends a substantial distance into the open space within the hot box beneath the lowermost ones of the heating elements 66 to provide preferential reflection of heat toward the front of the slot where heat losses are the greatest. In an alternative embodiment of the invention as shown in FIG. 4, a similarly located insulating layer 69*a* extends completely across the bottom of the open space in the hot box and is provided with a plurality of forwardly disposed slots 70 to provide preferential radiant heating of the forward portion of the slot.

As best shown in FIGS. 1 and 2, the entrance to the heating slot is defined at the top by a guide formed by a plurality of identical angled metal pieces 71 bolted at the top to a tubular support member 72 which is supported against the front wall of the hot box by a plurality of the tie rods 58. To that end, a number of brackets 73 are welded to the member 72 and extend under the lowermost insulating layer 60. Respective ones of the rods 58 extend through the brackets 73 and are held in place by the tie rod head 57. An elongated insulating member 74 rests on the pieces 71 below the lowermost insulating layer 60 as shown in FIG. 2. The guide formed by the individual pieces 71 thus protects the relatively fragile insulating pieces as the metal bars are inserted into the heating slot.

The furnace 10 is designed to operate in the normal forging temperature range of about 2000° F. to 2400° F. even though conventional metallic heating elements do not function satisfactorily at these high temperatures. Accordingly, ceramic-like silicon carbide elements of the type commonly known as glow bars are used as the heating elements 66. When such heating elements have a temperature below about 1400° F. they exhibit a nonreproducible operating electrical characteristic and when operated in groups as in the furnace 10, they do not evenly share the load nor is the power applied to each element equally distributed throughout the element itself thereby causing hot spots and shortened life. At temperatures above about 1400° F. the electrical characteristics of the elements are reproducible wherefor it is possible to balance the power to the elements and to balance the power within each element itself by properly designing the furnace and the power circuit.

In order to prevent the premature breakdown of the heating elements 66 there is provided in accordance with one feature of the invention means for maintaining the applied power level below the full rated value of the elements until the temperature of the heating elements is at a predetermined value above about 1400° F. The particular predetermined temperature may be as high as about 2000° F. and will depend on the size configuration, and composition of the heating elements. To this end, a thermocouple 76 is mounted in proximity to the central one of heating elements 66 (FIG. 2) and is connected to the power circuit so as to limit the level of applied power until the temperature of the heating elements reaches the predetermined value. The control circuit also includes a high temperature cut off which completely shuts off the application of power to the heating elements 66 when the thermocouple 76 senses an excess temperature condition, say approximately 2500° F.

Power to the heating elements 66 may, however, be increased as the temperature of the elements increases until the predetermined temperature of the heating elements has been reached. This may be characterized as a slope control. Thereafter, full power may be applied to the heating elements under the control of a pair of thermocouples 77 which are electrically connected in parallel and physically located a short distance above the open end of the heating slot near opposite ends thereof so as to respond to the average temperature in the heating slot.

Figure 8:
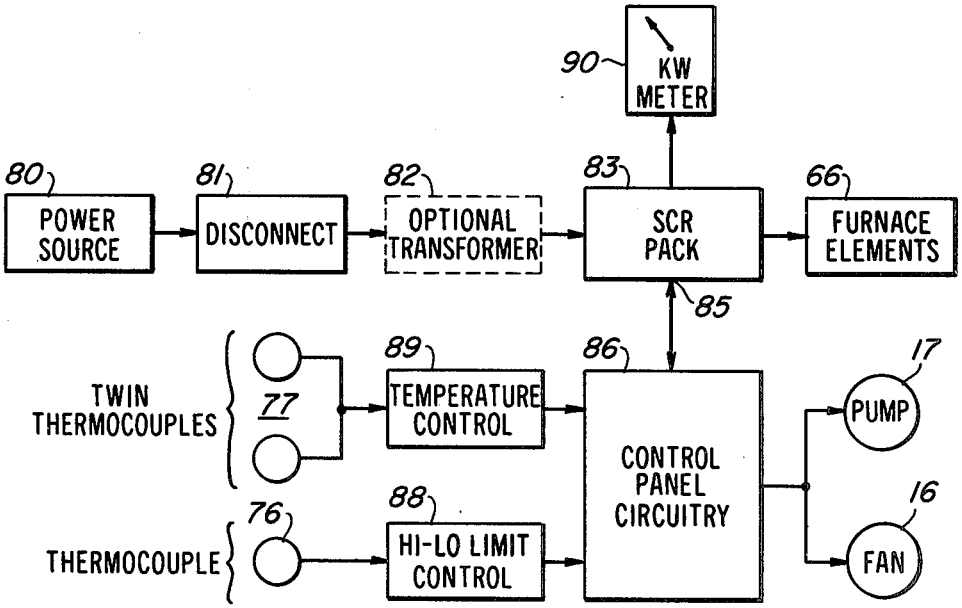
FIG. 8 is a block diagram of the electric control circuit for the furnace of FIG. 1.

Referring to FIG. 8, there is shown in block diagram form the electric control circuit for the furance 10. As there shown the power source 80 is connected through a suitable disconnect 81 including conventional circuit breakers and if desired a transformer 82, to a conventional three phase silicon controlled rectifier power pack 83 as sold, for example by Research, Inc., of Minneapolis, Minn. The glow bars 66 are connected in series parallel across the output of the power pack 83 whose output is controlled by a signal applied to an input 85 thereof. This control signal is provided by the control panel circuitry 86 which also controls the operation of the pump 17 and the cooling fan or blower 16.

The thermocouple 76 operates through a limit control device 88 to cause the control circuitry 86 to disable the power pack 83 when the thermocouple senses an excess temperature condition of say, 2500° F. or more. Moreover, when the thermocouple 76 senses a temperature below 1400° F. the control panel circuitry is operated to provide an output signal to the power pack 83 which limits the power output from the power pack to a fraction, say 30% of the power rating of the glow bars 66.

When the temperature sensed by the thermocouple 76 is between these high and low limits the control panel circuitry responds to the average of the output signals from the thermocouples 77 to cause the power pack 83 to apply full power to the glow bars when the average temperature sensed by the thermocouple 77 is below a set temperature of say 2400° F. and to fully modulate the supply of power to the elements from 0–100% of power depending on the heat loss of the furnace. The heat loss is the sum of the radiant slot loss, insulation losses, and the heat addition into the steel bars.

A wattmeter 90 is connected to the power pack 83 to provide a visual indication of the power being applied to the heating elements in the furnace. When the furnace is initially energized, the meter will have a relatively low reading until the glow bars reach the low limit temperature value of, for example, 1400° F. Full power is then applied to the heating elements wherefor the reading on the meter 90 increases quickly to a maximum value until the desired slot temperature has been reached. It then drops back to an equalibrium value, say 20% of maximum power. When cool bars 30 are placed in the slot, the slot temperature drops wherefor more power is again applied the heating elements and this is apparent because the meter reading again moves to a higher value and remains there until the bars have heated to the furnace temperature.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. An electric furnace having a hearth on which articles to be heated may be placed, comprising a resistance type electric heating element mounted in said furnace above said hearth, first temperature sensing means for sensing the temperature of said element, second temperature sensing means for sensing the temperature of said furnace in proximity to said hearth, and control means responsive to said first temperature sensing means for limiting the power to said element to a fraction of the power rating thereof when the temperature of said element is below a predetermined value, and responsive to said second temperature sensing means for controlling the power to said element in response to the temperature of said furnace in proximity to said hearth when the temperature of said element is above said predetermined value.

2. An electric furnace according to claim 1 wherein said control means interrupts the supply of power to said element when the temperature of said element is above a second predetermined value.

3. An electric furnace according to claim 1 wherein said first temperature sensing means comprises a temperature sensitive probe mounted in said furnace in proximity to said heating element.

4. An electric furnace according to claim 3 wherein said second temperature sensing means comprises a plurality of temperature sensitive probes electrically connected together in parallel and mounted in mutually spaced relationship above and in proximity to said hearth for sensing the average temperature in the space where said articles are placed to be heated.

5. An electric furnace according to claim 1 wherein said controls means increases the level of power applied to the heating elements as the temperature of the heating elements increases.

* * * * *